US008739890B2

(12) United States Patent
Noffke

(10) Patent No.: US 8,739,890 B2
(45) Date of Patent: Jun. 3, 2014

(54) MECHANICALLY ACTIVATED CONTINGENCY RELEASE SYSTEM AND METHOD

(75) Inventor: Richard P. Noffke, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/882,649

(22) PCT Filed: May 2, 2012

(86) PCT No.: PCT/US2012/036127

§ 371 (c)(1),
(2), (4) Date: Apr. 30, 2013

(87) PCT Pub. No.: WO2013/165412

PCT Pub. Date: Nov. 7, 2013

(65) Prior Publication Data

US 2014/0014364 A1 Jan. 16, 2014

(51) Int. Cl.
*E21B 17/06* (2006.01)
*E21B 23/02* (2006.01)

(52) U.S. Cl.
USPC ..... 166/380; 166/381; 166/242.6

(58) Field of Classification Search
CPC ..... E21B 23/00; E21B 23/02; E21B 43/10
USPC ..... 166/380, 381, 242.6
See application file for complete search history.

(56) References Cited

U.S. PATENT DOCUMENTS

| | | | | | |
|---|---|---|---|---|---|
| 3,104,708 | A | * | 9/1963 | Lindsey et al. | 166/382 |
| 4,477,104 | A | * | 10/1984 | Akkerman | 285/18 |
| 4,940,089 | A | | 7/1990 | Terral | |
| 5,074,362 | A | * | 12/1991 | Allwin | 166/382 |
| 5,343,954 | A | * | 9/1994 | Bohlen et al. | 166/382 |
| 5,787,982 | A | | 8/1998 | Bakke | |
| 6,425,443 | B1 | | 7/2002 | Hill et al. | |
| 2010/0282474 | A1 | | 11/2010 | Mohr | |

OTHER PUBLICATIONS

Foreign Communication from a Related Counterpart Application, International Search Report and Written Opinion dated Feb. 18, 2013, International Application Serial No. PCT/US12/36127, filed on May 2, 2012.

* cited by examiner

*Primary Examiner* — Kenneth L Thompson

(57) ABSTRACT

A release system comprises a torsional lock sleeve disposed about a mandrel, and a collet prop engaged with the mandrel. The torsional lock sleeve and the mandrel are configured to substantially prevent rotational movement of the torsional lock sleeve about the mandrel, and the torsional lock sleeve is configured to shift between a first position and a second position with respect to the mandrel. When the torsional lock sleeve is in the first position, the collet prop is retained in engagement with a collet and the collet prop is retained in a torsionally locked engagement with the torsional lock sleeve. The collet prop is configured to longitudinally translate in response to a rotational movement when the torsional lock sleeve is disposed in the second position. A shifting assembly is configured to engage the torsional lock sleeve and shift the torsional lock sleeve from the first position to the second position.

20 Claims, 6 Drawing Sheets

MECHANICALLY ACTIVATED CONTINGENCY RELEASE SYSTEM AND METHOD

CROSS-REFERENCE TO RELATED APPLICATIONS

This application is a filing under 35 U.S.C. 371 as the National Stage of International Application No. PCT/US12/36127, filed May 2, 2012, entitled "Mechanically Activated Contingency Release System and Method" by Richard P. Noffke, which is incorporated herein by reference in its entirety for all purposes.

BACKGROUND

Wellbores are sometimes drilled into subterranean formations that contain hydrocarbons to allow for recovery of the hydrocarbons. Once the wellbore has been drilled, various completion operations may be performed to configure the well for producing the hydrocarbons. Various tools may be used during the completion operations to convey the completions assemblies and/or components into the wellbore, perform the completion operations, and then disengage from the assemblies and/or components before retrieving the tools to the surface of the wellbore. However in some instances, the disengagement mechanism may not operate as intended, which may require that the completion assembly be removed from the wellbore with the tool or that the tool be left in the wellbore with the completion assembly.

SUMMARY

In an embodiment, a release system comprises a torsional lock sleeve disposed about a mandrel, and a collet prop engaged with the mandrel. The torsional lock sleeve and the mandrel are configured to substantially prevent rotational movement of the torsional lock sleeve about the mandrel, and the torsional lock sleeve is configured to shift between a first position and a second position with respect to the mandrel. The collet prop is retained in engagement with a collet when the torsional lock sleeve is in the first position, and the collet prop is retained in a torsionally locked engagement with the torsional lock sleeve when the torsional lock sleeve is in the first position. The collet prop is configured to longitudinally translate in response to a rotational movement when the torsional lock sleeve is disposed in the second position. A shifting assembly is configured to engage the torsional lock sleeve and shift the torsional lock sleeve from the first position to the second position.

In an embodiment, a release system comprises a torsional lock sleeve disposed about a mandrel, a collet prop engaged with the mandrel and the torsional lock sleeve, a collet engaged with the collet prop, and a shifting assembly configured to engage the torsional lock sleeve and shift the torsional lock sleeve from a first position to a second position. The torsional lock sleeve is torsionally locked with respect to the mandrel, and the engagement between the collet prop and the torsional lock sleeve is configured to torsionally lock the collet prop with respect to the torsional lock sleeve. The collet couples the collet prop to a downhole component.

In an embodiment, a method comprises engaging a shifting assembly with a torsional lock sleeve when the torsional lock sleeve is in a first position, longitudinally translating the torsional lock sleeve to a second position in response to the engagement of the shifting assembly with the torsional lock sleeve, applying a rotational force to the collet prop or the mandrel when the torsional lock sleeve is in the second position, longitudinally translating the collet prop based on the rotational force, and disengaging the collet prop from a collet based on the longitudinal translation of the collet prop. The torsional lock sleeve is torsionally locked with respect to a collet prop in the first position, and the torsional lock sleeve is torsionally locked with respect to a mandrel.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
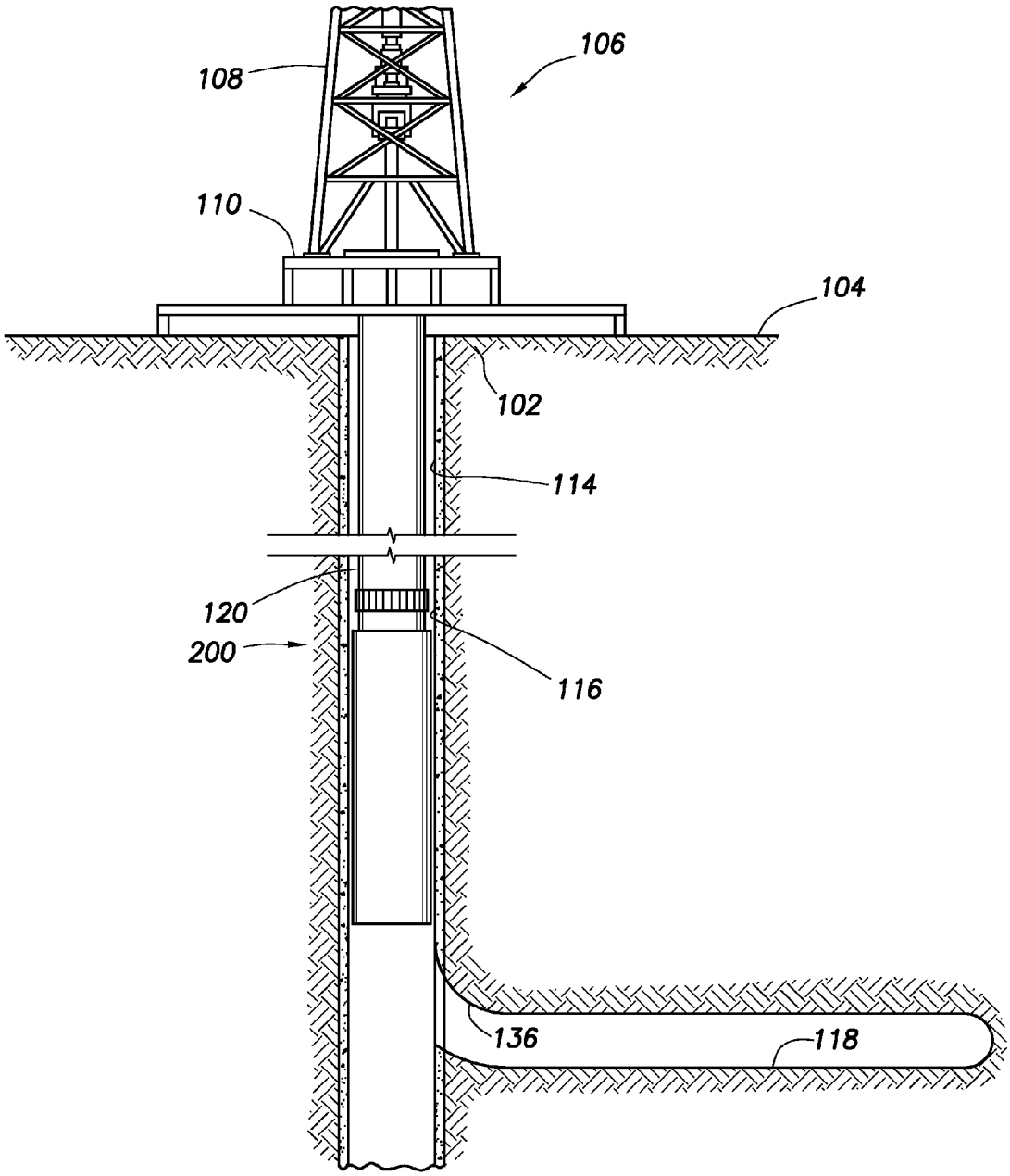
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

Several tools used in a servicing operation may comprise a collet configured to engage one or more other components. For example, a completion tool and/or a retrieval tool may comprise a collet having one or more lugs configured to engage a corresponding recess in a component for conveyance within the wellbore. The component may be conveyed into the wellbore and/or conveyed out of the wellbore for retrieval to the surface. A tool comprising a collet may comprise a collet prop to engage and maintain the collet in an engaged position. When the collet is ready to be released, the collet prop may be disengaged from the collet, thereby allowing the collet to be released from the component. The collet prop may be actuated through the use of a mechanical force supplied to the tool through a wellbore tubular extending to the surface of the wellbore. In some instances, the wellbore tubular and/or the tool may not be able to move, or move to the extent needed, to disengage the collet prop from the collet. In these instances, a release mechanism may be used to allow the collet prop to be disengaged from the collet, thereby allowing the tool comprising the collet to be disengaged from the component. Typically, the use of a release mechanism may involve additional steps or a sequence of actions to disengage the collet prop from the collet. These steps may be designed to reduce and/or eliminate the risk of unintentional, premature activation of the release mechanism.

As disclosed herein, the release mechanism may be configured to allow a collet prop to be disengaged from a collet through the use of a rotational force to rotate and provide a longitudinal translation of the collet prop. In order to prevent the premature actuation of the release mechanism, a torsional lock may engage the collet prop, thereby preventing the rotational motion of the collet prop. In a normal operating scenario, the release mechanism may operate based on a variety of inputs. For example, a downward force may be applied to the tool, which may be used to disengage the collet prop from the collet. However, in some instances, it may not be possible to apply a downward force to the tool. In an embodiment, the torsional lock within the release mechanism may be mechanically activated using a shifting assembly to translate a torsional lock sleeve with respect to the collet prop. The collet prop may comprise one or more splines over a portion of its surface. The translation of the torsional lock sleeve may allow the torsional lock sleeve to disengage from the splines, though the torsional lock sleeve may still be disposed about the collet prop. A rotational force may then be applied to the collet prop, which may be converted to a longitudinal translation through a force conversion mechanism to shift the collet prop out of engagement with the collet. The collet may then be disengaged from a downhole component with which it is engaged to allow the tool to be removed from the wellbore while leaving the downhole component in the wellbore. Thus, the mechanisms and methods described herein may provide a simple and effective means of releasing a downhole component from a tool. For example, the release mechanism may be used in the event that the normal release mechanism does not or cannot operate.

Turning to FIG. 1, an example of a wellbore operating environment is shown. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy and/or the production of water (e.g., potable water).

A wellbore tubular string 120 including a running tool that comprises a release mechanism coupled to a downhole component may be lowered into the subterranean formation 102 for a variety of drilling, completion, workover, and/or treatment procedures throughout the life of the wellbore. The embodiment shown in FIG. 1 illustrates the wellbore tubular 120 in the form of a completion string being lowered into the subterranean formation. It should be understood that the wellbore tubular 120 is equally applicable to any type of wellbore tubular being inserted into a wellbore, including as non-limiting examples drill pipe, production tubing, rod strings, and coiled tubing. In an embodiment, the downhole component may include, but is not limited to, a liner hanger, a liner (e.g., an expandable liner), a liner patch, a screen, or any combination thereof. The running tool may be used to convey the downhole component into the wellbore, and in some embodiments, the running tool may comprise one or more features used to actuate the downhole component (e.g., an expansion cone for an expandable liner hanger). In the embodiment shown in FIG. 1, the wellbore tubular 120 comprising the running tool may be conveyed into the subterranean formation 102 in a conventional manner and may subsequently be released from the component using a standard release mechanism or the release mechanism as described herein.

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the wellbore tubular 120 into the wellbore 114 to position the wellbore tubular 120 at a selected depth. While the operating environment depicted in FIG. 1 refers to a stationary drilling rig 106 for lowering and setting the wellbore tubular 120 comprising the running tool within a land-based wellbore 114, in alternative embodiments, mobile workover rigs, wellbore servicing units (such as coiled tubing units), and the like may be used to lower the wellbore tubular 120 comprising the running tool into a wellbore. It should be understood that a wellbore tubular 120 comprising the running tool may alternatively be used in other operational environments, such as within an offshore wellbore operational environment. In alternative operating environments, a vertical, deviated, or horizontal wellbore portion may be cased and cemented and/or portions of the wellbore may be uncased.

Regardless of the type of operational environment in which the running tool comprising the release mechanism 200 is used, it will be appreciated that the release mechanism 200 serves to allow the running tool to be disengaged from a downhole component, which in some embodiments may occur when a standard release mechanism cannot be actuated. The release mechanism 200 may utilize a different input than the standard release mechanism. As described in greater detail below with respect to FIG. 2, the release mechanism 200 generally comprises a torsional lock sleeve 202 disposed about a mandrel 204, and a collet prop 206 engaged with the mandrel 204. The coupling between the torsional lock sleeve 202 and the mandrel 204 may be configured to substantially prevent rotational movement of the torsional lock sleeve 202 about the mandrel 204 while allowing for longitudinal translation of the torsional lock sleeve 202 between a first position in which the torsional lock sleeve 202 forms a torsional lock with the collet prop 206 and a second, shifted position in which the torsional lock sleeve releases the torsional lock with respect to the collet prop 206. When the torsional lock sleeve 202 is in the first position, the collet prop 206 may be retained in engagement with a collet 208, and when the torsional lock sleeve 202 is in the shifted position, the collet prop 206 may be able to longitudinally translate out of engagement with the collet 208, thereby allowing the collet 208 to contract inwards and release from the downhole component 210. As described in more detail below, the longitudinal translation of the collet prop 206 may result from the rotation of the collet prop 206 and/or the mandrel 204.

Figure 2:
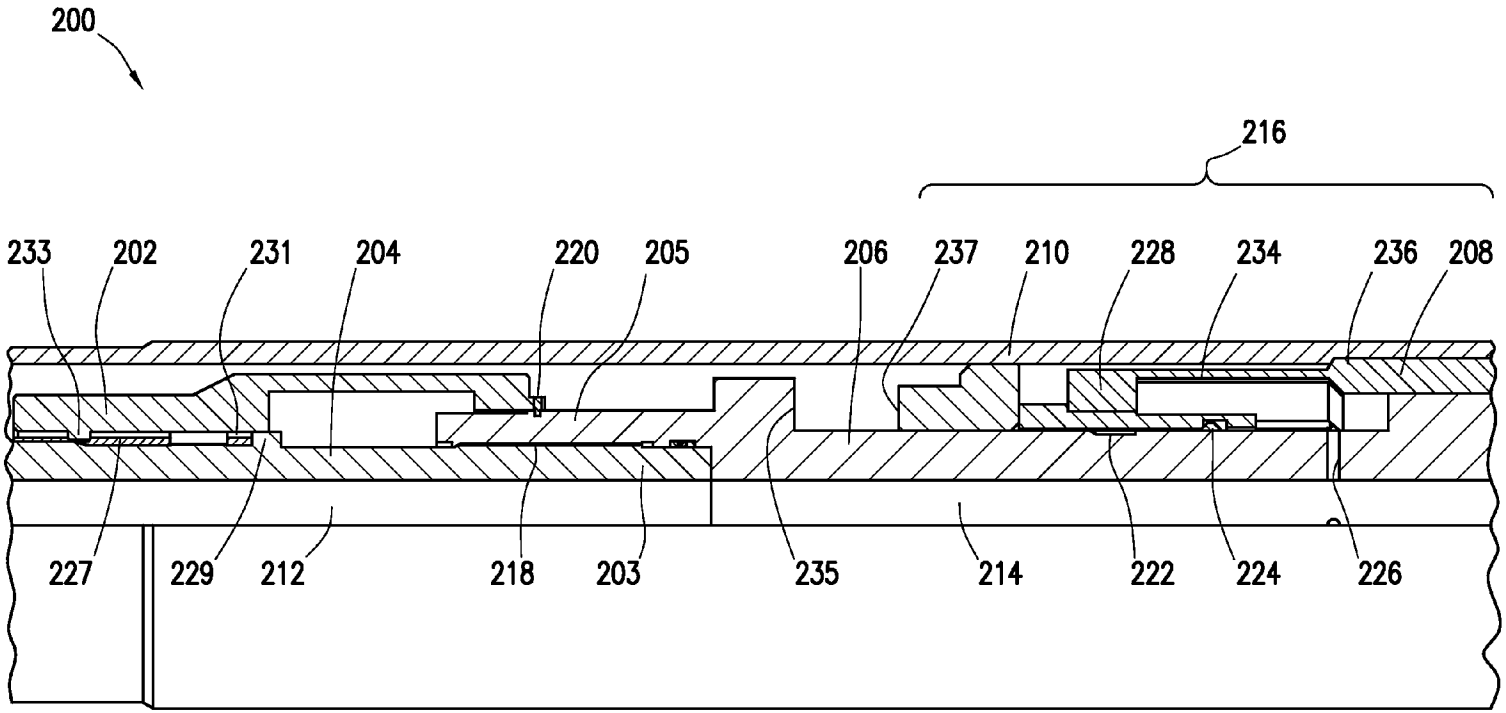
FIG. 2 is a cut-away view of an embodiment of a release mechanism.

As shown in FIG. 2, an embodiment of the release mechanism 200 comprises a mandrel 204 having a torsional lock sleeve 202 disposed thereabout, and a collet prop 206 engaged with the mandrel 204. A shifting assembly can be used to engage and shift the torsional lock sleeve 202 with respect to the mandrel 204 and the collet prop 206, as described in more detail below. The mandrel 204 generally comprises a tubular member having a flowbore 212 extending between each end of the mandrel 204. The size of the flowbore 212 may be selected to allow fluid flow therethrough at a desired rate during normal operation and/or to allow installation of the running tool and the downhole component. The mandrel 204 may comprise a generally cylindrical member, though other shapes are also possible. The ends of mandrel 204 may be configured to allow for a connection to another component above and/or below the mandrel 204. For example, the mandrel 204 may comprise one or more ends with a threaded connection (e.g., a box or pin type connection) to allow for the mandrel 204 to be coupled to another component such as the wellbore tubular used to convey the mandrel into the wellbore. In an embodiment, an end 203 of the mandrel 204 is coupled to the collet prop 206. A force conversion mechanism may be used to couple the end 203 of the mandrel 204 to an end 205 of the collet prop 206, as described in more detail herein.

In an embodiment, the release mechanism 200 comprises a torsional lock sleeve 202 disposed about the mandrel 204. The torsional lock sleeve 202 may generally be configured to shift or translate with respect to the mandrel 204 in response to the application of a force to the torsional lock sleeve 202. In an embodiment, the torsional lock sleeve 202 may be configured to translate in response to a mechanical force applied to the torsional lock sleeve 202, though in some embodiments, other inputs may be used to cause the torsional lock sleeve 202 to translate. The torsional lock sleeve 202 generally comprises a tubular member disposed about the mandrel 204, and the torsional lock sleeve 202 is generally sized to be disposed about the mandrel 204 while allowing for longitudinal movement with respect to the mandrel 204. The outer diameter of the mandrel 204 may vary along the length over which the torsional lock sleeve 202 can travel about the mandrel 204. The outer diameter of a first section of the mandrel 204 above (e.g., to the left in FIG. 2) the torsional lock sleeve 202 may be greater than the outer diameter of a recess 227 in the mandrel 204 about which the torsional lock sleeve 202 can be disposed. A flange 229 having a greater outer diameter than the recess 227 may be disposed adjacent the recess 227, thereby forming a shoulder 231 at the transition between the recess 227 and the flange 229. A protrusion 233 on the inner surface of the torsional lock sleeve 202 may be configured to engage the shoulder 231, thereby preventing further translation of the torsional lock sleeve 202 with respect to the mandrel 204.

In an embodiment, the torsional lock sleeve 202 may be configured to shift in response to a force from the shifting assembly. The torsional lock sleeve 202 may longitudinally translate with respect to the mandrel 204 with a force sufficient to shear or otherwise exceed a threshold associated with a retaining mechanism 220, as described in more detail herein. The torsional lock sleeve 202 may translate until the protrusion 233 engages the flange 229 on the mandrel 204. The translation of the torsional lock sleeve 202 may then occur between an initial position (e.g., a first position) in which the torsional lock sleeve 202 is torsionally locked with respect to the mandrel 204 and the collet prop 206 and a shifted position in which the torsional lock sleeve 202 has shifted out of a torsionally locked engagement with the collet prop 206 a distance sufficient to allow the collet prop 206 to disengage from the collet 208. In the shifted position, the torsional lock sleeve 202 may remain torsionally locked with respect to the mandrel 204.

As noted above, the torsional lock sleeve 202 and the mandrel 204 may be configured to substantially prevent rotational movement of the torsional lock sleeve 202 about the mandrel 204. The limitation and/or restraint on the rotational movement of the torsional lock sleeve 202 relative to and about the mandrel 204 may be referred to as the torsional lock. Various configurations may be used to limit the rotational movement of the torsional lock sleeve 202 with respect to the mandrel 204. For example, the mandrel 204 may comprise one or more splines configured to engage one or more corresponding splines on the torsional lock sleeve 202, where the engagement of the one or more splines on the mandrel 204 with the one or more splines on the torsional lock sleeve 202 provide the torsional lock of the torsional lock sleeve 202 with respect to the mandrel 204. Alternatively, a lug and groove configuration may be used with a lug disposed on an inner surface of the torsional lock sleeve 202 or an outer surface of the mandrel 204 and a corresponding groove disposed on the opposite surface to receive the lug.

Figure 3:
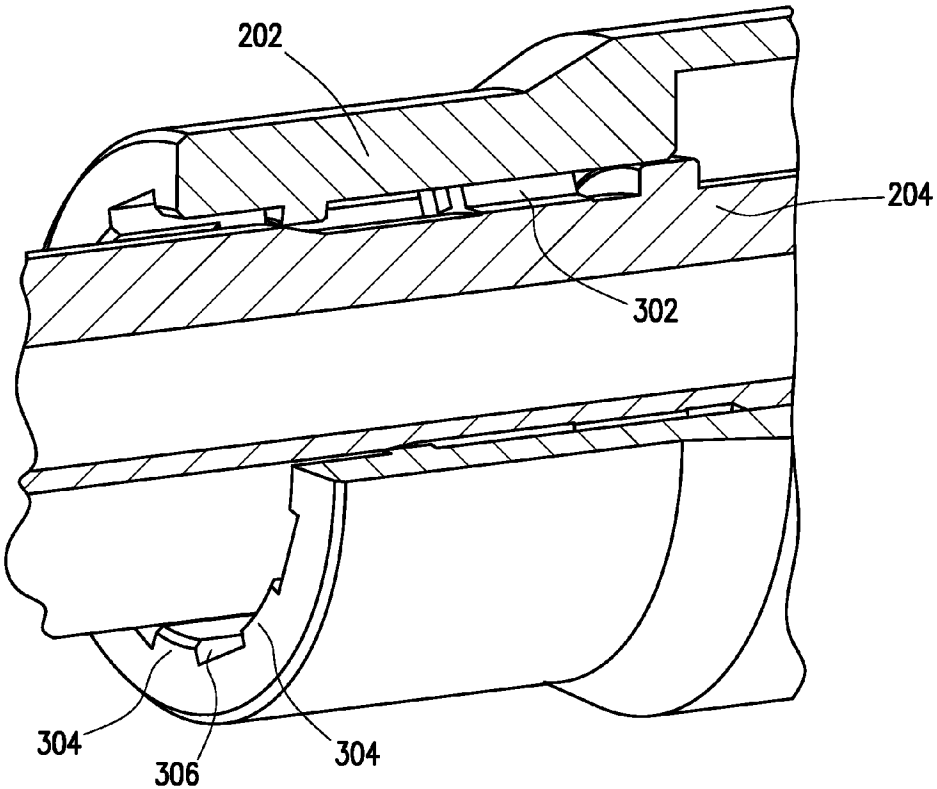
FIG. 3 is a cut-away view of an embodiment of a torsional lock sleeve engaging a mandrel.

An embodiment illustrating the use of corresponding and interlocking splines is shown in FIG. 3. As illustrated, a first plurality of splines 302 may be formed over a portion of an outer surface of the mandrel 204. Each spline 302 has a length that extends longitudinally over a portion of the outer surface of the mandrel 204 and is substantially longitudinally aligned with the central axis of the mandrel 204. Thus, the splines 302 may also be referred to as longitudinal splines 302. Each spline 302 also has a height that extends substantially radially outward from the outer surface of the mandrel 204. A recess is formed between each pair of adjacent splines 302. Longitudinally aligned splines 302 may be configured to matingly engage and interlock with a set of longitudinal splines 304 formed on an inner surface of the torsional lock sleeve 202. A second plurality of splines 304 may be formed over a portion of an inner surface of the torsional lock sleeve 202. Each spline 304 has a length that extends longitudinally over a portion of the inner surface of the torsional lock sleeve 202. The length of the splines 304 may be configured to allow the splines 304 to engage the splines 302 over the travel distance of the torsional lock sleeve 202. The splines 304 may be substantially longitudinally aligned, and thus, the splines 304 may also be referred to as longitudinal splines 304. Each spline 304 also has a height that extends substantially radially inward from the inner surface of the torsional lock sleeve 202. A recess 306 is formed between each pair of adjacent splines 304. In this embodiment, the torsional lock sleeve 202 and the mandrel 204 may be coupled together by engaging and interlocking longitudinal splines 302 on the mandrel 204 with the corresponding longitudinal splines 304 on the torsional lock sleeve 202 to form a torsionally locked engagement. The torsionally locked engagement substantially prevents relative rotational movement between the torsional lock sleeve 202 and the mandrel 204, while allowing for longitudinal movement between the torsional lock sleeve 202 and the mandrel 204.

In another embodiment, a lug and groove configuration may be used to limit the rotational movement of the torsional lock sleeve 202 with respect to the mandrel 204. In this embodiment, one or more lugs may be formed on a portion of the outer surface of the mandrel 204. The lug may generally comprise a protrusion extending from the outer surface of the mandrel 204, and the lug may comprise a variety of shapes including circular, square, rectangular, elliptical, oval, diamond like, etc. The one or more lugs may have a height that extends substantially radially outward from the outer surface of the mandrel 204. The lug may be configured to engage and translate within a groove formed on an inner surface of the torsional lock sleeve 202. One or more grooves, that may or may not correspond to the number of lugs, may be formed over a portion of the inner surface of the torsional lock sleeve 202. Each groove has a length that extends longitudinally over a portion of the inner surface of the torsional lock sleeve 202 and is substantially longitudinally aligned. Thus, the one or more grooves may be referred to as longitudinal grooves. Each groove has a depth that extends substantially radially outward from the inner surface of the torsional lock sleeve 202 and a width that extends along the inner circumference of the torsional lock sleeve 202. The depth and width of the groove may be configured to receive the lug within the groove. The lug may then be free to travel within the groove while being substantially restrained from movement perpendicular to the length of the groove. In this embodiment, the torsional lock sleeve 202 and the mandrel 204 may be coupled together by engaging the lug on the mandrel 204 with a corresponding groove on the torsional lock sleeve 202 to form a torsionally locked engagement. While the lug may follow within the longitudinal groove, the interaction of the lug with the sides of the longitudinal groove may substantially prevent relative rotational movement between the torsional lock sleeve 202 and the mandrel 204, thereby forming a torsional lock between the torsional lock sleeve 202 and the mandrel 204. While described with respect to the lug being disposed on the mandrel 204 and the groove being disposed on the torsional lock sleeve 202, the positioning of the lug and groove could be exchanged to allow for an equivalent torsional lock between the torsional lock sleeve 202 and the mandrel 204.

A shifting assembly may be configured to engage the torsional lock sleeve 202 and shift the torsional lock sleeve from the first position. The shifting assembly is generally configured to provide a mechanical force to the torsional lock sleeve 202. The shifting assembly may comprise a variety of designs including a piston, an expansion tool, a mechanically actuated component, a wellbore tubular (e.g., an overshot type fishing tool), or any other device capable of applying a mechanical force to the torsional lock sleeve. In an embodiment, the shifting assembly comprises a piston. In this embodiment, the piston may be disposed in the annular region between mandrel 204 and the downhole component 210. The piston may form a seal with the mandrel 204 and an inner surface of the downhole component 210. A fluid pressure may be introduced above the piston to move the piston into engagement with the torsional lock sleeve 202. The piston and/or fluid pressure may be configured to shift the torsional lock sleeve 202 from the first position to a second position. In an embodiment, the piston may comprise an expansion tool (e.g., an expansion cone) for an expandable liner hanger. In this embodiment, the expansion tool may comprise a piston configured in a wedge shape. Upon translation of the expansion tool in the annular region between the mandrel 204 and the downhole component 210 (e.g., an expandable liner hanger), the expansion tool may cause the downhole component 210 to radially expand and engage an inner surface of the wellbore and/or casing. The downhole component 210 may then be retained in position through a friction interface between the downhole component 210 and the wellbore wall and/or casing. At the end of the expansion stroke, the expansion tool may apply a force to the torsional lock sleeve 202 to shift the torsional lock sleeve from the first position. When the expansion tool engages the recess 227 on the outer surface of the mandrel 204, a seal between the expansion tool and the mandrel 204 may no longer seal against the mandrel 204, allowing the fluid pressure driving the expansion tool to vent through the recess 227 and past the torsional lock sleeve 202. With the loss of the pressure behind the expansion tool, the pressure differential driving the expansion tool may be reduced or eliminated. The expansion tool may then be retained in position, and may retain the torsional lock sleeve 202 in position, based on friction interference between the expansion tool and the downhole component 210.

The shifting assembly may also comprise a mechanically actuated component. In an embodiment, the shifting assembly may comprise a shifting sleeve having a portion disposed within the flowbore 212. For example, an indicator may be disposed within the flowbore 212 and actuated by a wellbore tubular, a collet, or any other mechanical apparatus. The shifting sleeve may be configured to transfer a force applied to the indicator to the torsional lock sleeve, thereby allowing a mechanical force applied to the indicator to be applied to the torsional lock sleeve 202. In another embodiment, the indicator may comprise a valve seat or other similar structure. A ball, dart, or other sealing element may be disposed within the flowbore 212 and engage the indicator. Upon forming a seal, a pressure may be applied to the sealing element, which may apply a force to the indicator. The indicator may then be configured to transfer a force applied to the indicator to the torsional lock sleeve, thereby allowing a mechanical force applied to the indicator to be applied to the torsional lock sleeve 202. Any other structures configured to apply a mechanical force to the torsional lock sleeve may also be used with the release mechanism 200 disclosed herein.

Returning to FIG. 2, the collet prop 206 generally comprises a tubular member that is configured to engage the mandrel 204. In an embodiment, an end 203 of the mandrel 204 is configured to engage an end 205 of the collet prop 206. One or more seals (e.g., O-ring seals) may be disposed in corresponding recesses (e.g., seal glands) to provide a substantially fluid-tight seal between the collet prop 206 and the mandrel 204. The collet prop 206 generally comprises a tubular member having a flowbore 214 extending between each end of the collet prop 206. The size of the flowbore 214 may be selected to allow fluid flow therethrough at a desired rate during normal operation and/or to allow installation of the running tool and the downhole component. The collet prop 206 may comprise a generally cylindrical member, though other shapes are also possible. The flowbore 214 may be sized to correspond with the flowbore 212 through the mandrel 204 to allow for a substantially uniform flowbore through both the mandrel 204 and the collet prop 206. The ends of collet prop 206 may be configured to allow for a connection to another component above and/or below the mandrel 204. For example, the collet prop 206 may comprise one or more ends with a threaded connection (e.g., a box or pin type connection) to allow for the collet prop 206 to be coupled to another component below the collet prop.

In an embodiment, the collet prop 206 generally extends between the first end 205 that is configured to engage the mandrel 204 and the torsional lock sleeve 202 and a second portion 216 configured to engage and maintain a collet 208 in engagement with a downhole component 210. The second portion 216 may comprise an end of the collet prop 206, or the collet prop 206 may extend beyond the collet 208 as shown in FIG. 2. In an embodiment, the collet prop 206 may be retained in engagement with a collet 208 when the torsional lock sleeve 202 is in the first position, and the collet prop 206 may be able to longitudinally translate out of engagement with the collet 208 when the torsional lock sleeve 202 is in the second, shifted position. A first end 205 of the collet prop 206 may be configured to engage the torsional lock sleeve 202, and as described in more detail below, the engagement between the torsional lock sleeve 202 and the collet prop 206 may form a torsional lock when the torsional lock sleeve is in the first position.

The collet prop 206 may also comprise a ring slot 222 disposed on an outer surface of the collet prop 206. The ring slot 222 may be configured to receive a retaining ring 224 disposed in a recess on a portion of the collet assembly 228. When the collet prop 206 translates out of alignment with the collet 208 as described in more detail herein, the ring slot 222 may be radially aligned with the retaining ring 224. At this point, the retaining ring 224, may contract inwards to engaged and be retained within the ring slot 222, while remaining engaged in the recess on the collet assembly 228. The retaining ring 224 may then serve to longitudinally lock the collet prop 206 to the collet assembly 228. In this configuration, the mandrel 204 and collet prop 206 may be conveyed within the wellbore while retaining the collet assembly 228 and the collet 208 in a disengaged configuration.

The collet prop 206 may also comprise one or more ports 226. The ports 226 may provide for fluid venting from the annular region between the mandrel 204 and the downhole component 210 and/or the collet prop 206 and the downhole component 210. Venting may be used when the shifting assembly comprises a piston that is vented upon translating the torsional lock sleeve 202. Venting may also be useful to allow the various components (e.g., the torsional lock sleeve 202, the collet prop 206, the collet 208, etc.) to move relative to one another without accumulating pressure between the various components. While the one or more ports 226 are illustrated as being disposed in the collet prop 206, the one or more ports could also be disposed in the mandrel 204 to provide for the same venting of a fluid from the annular region.

In an embodiment, a retaining mechanism 220 may be engaged with the torsional lock sleeve 202 and the collet prop 206 the mandrel 204, and/or the downhole component 210. As illustrated in FIG. 2, the retaining mechanism 220 may be configured to prevent the torsional lock sleeve 202 from shifting until a force exceeding a threshold is applied to the retaining mechanism 220. As described in more detail herein, the torsional lock sleeve 202 may be substantially restrained from rotating relative to the mandrel 204 and the collet prop 206 when the torsional lock sleeve 202 is in the first position, and the retaining mechanism 220 may then be considered to prevent the torsional lock sleeve 202 from longitudinally translating from the first position until a force exceeding a threshold is applied to the retaining mechanism 220. Suitable retaining mechanisms may include, but are not limited to, shear pins, shear rings, shear screws, or any combination thereof. While illustrated as engaging the torsional lock sleeve 202 and the collet prop 206 in FIG. 2, the retaining mechanism 220 may alternatively or additionally engage the torsional lock sleeve 202 and the mandrel 204 and/or the torsional lock sleeve 202 and the downhole component 210. In an embodiment, one or more retaining mechanisms 220 may be used to provide the desired threshold force that is needed to initiate the translation of the torsional lock sleeve 202.

In general, a collet 208 comprises one or more springs 234 (e.g., beam springs) and/or spring means separated by slots. In an embodiment, the slots may comprise longitudinal slots, angled slots, as measured with respect to the longitudinal axis, helical slots, and/or spiral slots for allowing at least some radial compression in response to a radially compressive force. A collet 208 may generally be configured to allow for a limited amount of radial compression of the springs 234 in response to a radially compressive force, and/or a limited amount of radial expansion of the springs 234 in response to a radially expansive force. The collet 208 also comprises a collet lug 236 disposed on the outer surface of the springs 234. In an embodiment, the collet 208 used with the release mechanism as shown in FIG. 2 may be configured to allow for a limited amount of radial compression of the springs 234 and collet lug 236 in response to a radially compressive force. The radial compression may allow the springs 234 to pass by a portion of the downhole component 210 having an inner surface with a reduced diameter before allowing the collet lug to expand into a corresponding recess disposed on an inner surface of the downhole component 210. The collet lug 236 and/or the inner surface of the downhole component 210 may comprise one or more surfaces configured to engage and provide a radially compressive force to the springs 234 when the collet lug 236 contacts the downhole component 210.

Once engaged with the downhole component 210, the collet may be free to radially compress unless supported by the collet prop 206. In the engaged position, the collet prop 206 may generally engage and be disposed in radial alignment with the springs 234 and/or the collet lug 236. The collet prop 206 may generally be resistant to radially compressive forces, and when the collet prop 206 is disposed in radial alignment with the springs 234 and/or the collet lug 236, the springs 234 may be prevented from radially compressing. When the collet lug 236 is engaged in the corresponding recess in the downhole component 210 and engaged with the collet prop 206, the collet 208 may fixedly couple the running tool to the downhole component 210. When the collet prop 206 is disengaged from the collet 208, the springs 234 and/or the collet lug 236 may be free to radially compress and move out of the recess in the downhole component 210, thereby releasing the downhole component 210 from the running tool. The collet prop 206 may be described as being disengaged from the collet 208 when the collet springs 234 and/or the collet lug 236 is able to radially compress out of a fixed engagement with the recess in the downhole component 210. This may include when the collet prop 206 is translated out of radial alignment with the springs 234 and/or the collet lug 236, or when one or more recesses of a sufficient depth on the collet prop 206 are radially aligned with the springs 234 and/or the collet lug 236, thereby allowing the springs 234 to radially compress into the recess and disengage from the recess in the downhole component 210.

In an embodiment, the collet prop 202, the collet 208, and the downhole component 210 may be torsionally locked with respect to one another. In this embodiment, the collet prop 206 may engage the collet 208 with a splined configuration. The outer surface of the collet prop 206 configured to engage the collet 208 may be splined, crenellated, corrugated, castellated, or otherwise featured to engage the collet and one or more corresponding features on the collet 208 to thereby provide a torsional lock between the collet prop 206 and the collet 208. The engagement between the collet 208 and the downhole component 210 may also be torsionally locked. In this embodiment, the collet 208 may engage the downhole component 210 with a splined configuration. The outer surface of the collet 208 configured to engage the downhole component 210 may be splined, crenellated, corrugated, castellated, or otherwise featured to engage the downhole component 210 and one or more corresponding features on the downhole component 210 to thereby provide a torsional lock between the collet 208 and the downhole component 210. In this embodiment, the mandrel 204 may be torsionally locked with respect to the downhole component 210 when the torsional lock sleeve 202 is in the first position due to the torsional locks between the mandrel 204 and the torsional lock sleeve 202, the torsional lock sleeve 202 and the collet prop 206, the collet prop 206 and the collet 208, and the collet 208 and the downhole component 210.

While described with respect to a collet 208 being disposed within the downhole component 210 and the collet prop 206 being disposed in radial alignment inside the collet 208, it will be appreciated that the arrangement of the parts may be reconfigured without departing from the scope of the present description. For example, the collet could be disposed outside of the downhole component and engage a recess in an outer surface of the downhole component. In this embodiment, the collet prop may be disposed outside of and in radial alignment with the collet. This configuration would allow the collet prop to prevent the radial expansion of the springs and/or the collet lug to thereby maintain an engagement between the collet and the downhole component. Other configurations and arrangements may also be possible.

As shown in FIG. 2, the engagement between the collet prop 206 and the torsional lock sleeve 202 may be configured to torsionally lock the collet prop 206 with respect to the torsional lock sleeve 202 when the torsional lock sleeve 202 is in the first position, where the torsional lock sleeve 202 may in turn be torsionally locked with respect to the mandrel 204. As described above, the torsional lock between the collet prop 206 and the torsional lock sleeve 202 is configured to restrain the collet prop 206 from rotational motion relative to the torsional lock sleeve 202. In an embodiment, the collet prop 206 and the torsional lock sleeve 202 may comprise one or more mating and interlocking features that, once engaged, substantially prevent rotational motion between the collet prop 206 and the torsional lock sleeve 202. For example, the collet prop 206 may comprise one or more splines configured to engage one or more corresponding splines on the torsional lock sleeve 202, where the engagement of the one or more splines on the collet prop 206 with the one or more splines on the torsional lock sleeve 202 provide the torsional lock of the torsional lock sleeve 202 with respect to the collet prop 206. Alternatively, a lug and groove configuration may be used with a lug disposed on an inner surface of the torsional lock sleeve 202 or an outer surface of the collet prop 206 and a corresponding groove disposed on the opposite surface to receive the lug.

Figure 4:
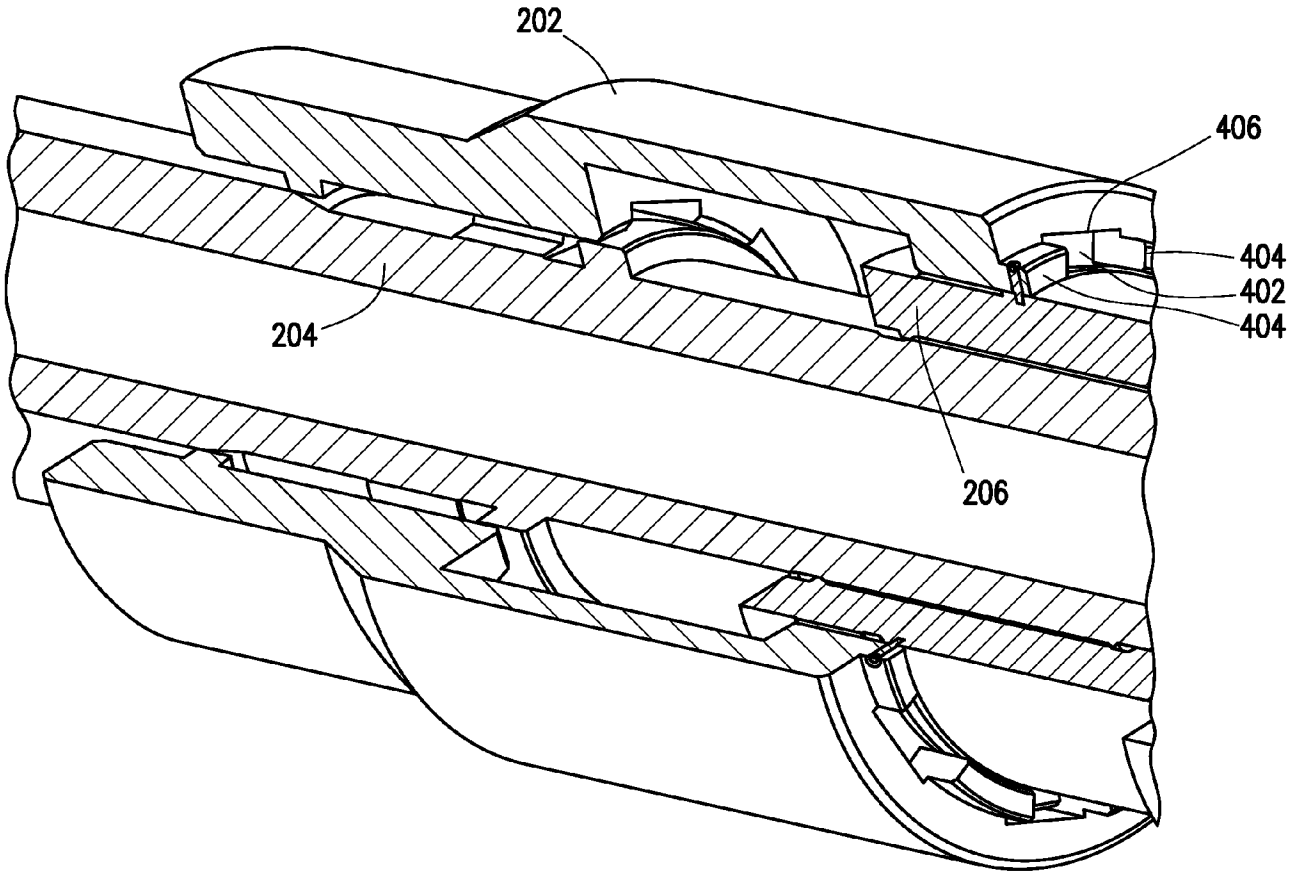
FIG. 4 is another cut-away view of an embodiment of a torsional lock sleeve engaging a collet prop.

An embodiment of the interlocking features comprising corresponding splines on the collet prop 206 and the torsional lock sleeve is shown in FIG. 4. In an embodiment, the corresponding and interlocking splines may be similar to those described with respect to the torsional lock between the mandrel 204 and the torsional lock sleeve 202 above. As illustrated, a first plurality of splines 402 may be formed over a portion of an outer surface of the collet prop 206. Each spline 402 has a length that extends longitudinally over a portion of the outer surface of the collet prop 206 and is substantially longitudinally aligned with the central axis of the collet prop 206. Thus, the splines 402 may also be referred to as longitudinal splines 402. Each spline 402 also has a height that extends substantially radially outward from the outer surface of the collet prop 206. A recess is formed between each pair of adjacent splines 402. Longitudinally aligned splines 402 may be configured to matingly engage and interlock with a set of longitudinal splines formed on an inner surface of the torsional lock sleeve 202. A second plurality of splines 404 may be formed over a portion of an inner surface of the torsional lock sleeve 202. Each spline 404 has a length that extends longitudinally over a portion of the inner surface of the torsional lock sleeve 202. The length of the splines 404 may be configured to allow the splines 404 to engage the splines 402 over a first portion of the travel distance of the torsional lock sleeve 202 while being out of engagement with the splines 402 over a second portion of the travel distance of the torsional lock sleeve 202. The splines 404 may be substantially longitudinally aligned, and thus, the splines 404 may also be referred to as longitudinal splines 404. Each spline 404 also has a height that extends substantially radially inward from the inner surface of the torsional lock sleeve 202. A recess 406 is formed between each pair of adjacent splines 404. In this embodiment, the torsional lock sleeve 202 and the collet prop 206 may be coupled together by engaging and interlocking longitudinal splines 402 on the collet prop 206 with the corresponding longitudinal splines 404 on the torsional lock sleeve 202 to form a torsionally locked engagement when the torsional lock sleeve 202 is in the first position. The torsionally locked engagement substantially prevents relative rotational movement between the torsional lock sleeve 202 and the collet prop 206. The corresponding splines 402, 404 may not be torsionally locked when the torsional lock sleeve 202 is shifted from the first position.

In another embodiment, a lug and groove configuration may be used to limit the rotational movement of the torsional lock sleeve 202 with respect to the collet prop 206. In this embodiment, one or more lugs may be formed on a portion of the outer surface of the collet prop 206. The lug may generally comprise a protrusion extending from the outer surface of the collet prop 206, and the lug may comprise a variety of shapes including circular, square, rectangular, elliptical, oval, diamond like, etc. The one or more lugs may have a height that extends substantially radially outward from the outer surface of the collet prop 206. The lug may be configured to engage and translate within a groove formed on an inner surface of the torsional lock sleeve 202. One or more grooves, that may or may not correspond to the number of lugs, may be formed over a portion of the inner surface of the torsional lock sleeve 202. Each groove has a length that extends longitudinally over a portion of the inner surface of the torsional lock sleeve 202 and is substantially longitudinally aligned. Thus, the one or more grooves may be referred to as longitudinal grooves. Each groove has a depth that extends substantially radially outward from the inner surface of the torsional lock sleeve 202 and a width that extends along the inner circumference of the torsional lock sleeve 202. The depth and width of the groove may be configured to receive the lug within the groove. The lug may then be free to travel within the groove while being substantially restrained from movement perpendicular to the length of the groove. In this embodiment, the torsional lock sleeve 202 and the collet prop 206 may be coupled together by engaging the lug on the collet prop 206 with a corresponding groove on the torsional lock sleeve 202 to form a torsionally locked engagement. While the lug may follow within the longitudinal groove, the interaction of the lug with the sides of the longitudinal groove may substantially prevent relative rotational movement between the torsional lock sleeve 202 and the collet prop 206, thereby forming a torsional lock between the torsional lock sleeve 202 and the collet prop 206. While described with respect to the lug being disposed on the collet prop 206 and the groove being disposed on the torsional lock sleeve 202, the positioning of the lug and groove could be exchanged to allow for an equivalent torsional lock between the torsional lock sleeve 202 and the collet prop 206.

Returning to FIG. 2, a force conversion mechanism 218 formed by the engagement of the collet prop 206 and the mandrel 204 may be configured to convert a rotational force into a longitudinal force. As used herein, a "rotational force" refers to any force that results in a rotational movement of a component, regardless of its actual vector alignment. In an embodiment, the force conversion mechanism 218 is configured to convert a rotation into a longitudinal translation. Once the torsional lock sleeve 202 is translated out of the torsionally locked engagement with the collet prop 206, the collet prop 206 may be free to rotate relative to the mandrel 204. The relative rotation may be used to longitudinally translate the collet prop 206 out of engagement with the collet (e.g., out of radial alignment with the springs 234 and/or the collet lug 236). The rotational force may be applied to the mandrel 204, the collet prop 206, and/or the downhole component 210 to result in the rotational movement of one or more of the components. In an embodiment, the collet prop 206 may be substantially rotationally fixed relative to the downhole component 210, which may be substantially rotationally fixed relative to the wellbore. The mandrel 204 may then be rotated to impart a rotational force to the force conversion mechanism 218. In an embodiment, the force conversion mechanism is configured to convert a rotational force applied to the mandrel 204 and/or the collet prop 206 into a longitudinal translation of the collet prop 206 with respect to the mandrel 204. The longitudinal translation may be sufficient to disengage the collet prop 206 from the collet 208. As noted above, this may include when the collet prop 206 is translated out of radial alignment with the springs 234 and/or the collet lug 236, or when one or more recesses of a sufficient depth on the collet prop 206 are radially aligned with the springs 234 and/or the collet lug 236, thereby allowing the springs 234 to radially compress into the recess and disengage from the recess in the downhole component 210. In an embodiment, the force conversion mechanism 218 may comprise a threaded engagement between the collet prop 206 and the mandrel 204, a helical groove disposed in an outer surface of the mandrel 204 and one or more corresponding lugs disposed on an inner surface of the collet prop 206, or vice versa, and/or a helical spline disposed in an outer surface of the mandrel 204 and one or more corresponding splines disposed on an inner surface of the collet prop 206. While illustrated in FIG. 2 as having the end 205 of the collet prop 206 disposed about the end 203 of the mandrel 204, it will be appreciated that the relative positions of the ends 203, 205 could be reversed while still maintaining the same functional relationship between the collet prop 206 and the mandrel 204.

In an embodiment, the force conversion mechanism 218 comprises a threaded engagement between the collet prop 206 and the mandrel 204. In this embodiment, the end 205 of the collet prop 206 may comprise threads that are configured to engage and mate corresponding threads on the end 203 of the mandrel 204. The collet prop 206 may then be installed by engaging the threads on the collet prop 206 onto the mandrel 204 until the collet prop 206 is engage with the collet 208. When the torsional lock sleeve 202 is translated out of the torsionally locked engagement with the collet prop 206, the mandrel 204 may be rotated, and the rotation of the mandrel 204 may be converted into a downward longitudinal movement of the collet prop 206 due to the interaction of the threads on the mandrel 204 with the threads on the collet prop 206. In an embodiment, the threads may comprise left handed threads. The use of left handed threads may allow for a rotation to the right to translate the collet prop 206, which may avoid potentially un-torqueing one or more joints of wellbore tubular or similar connections used to convey the running tool into the wellbore.

In another embodiment, the force conversion mechanism 218 may comprise a helical groove disposed in an outer surface of the mandrel 204 and one or more corresponding lugs disposed on an inner surface of the collet prop 206. In this embodiment, one or more lugs may be formed on a portion of the inner surface of the collet prop 206. The lug may generally comprise a protrusion extending from the inner surface of the collet prop 206, and the lug may comprise a variety of shapes including circular, square, rectangular, elliptical, oval, diamond like, etc. The one or more lugs may have a height that extends substantially radially inward from the inner surface of the collet prop 206. The lug may be configured to engage and translate within a groove formed on an outer surface of the mandrel. One or more grooves, that may or may not correspond to the number of lugs, may be formed over a portion of the outer surface of the mandrel 204. Each groove has a length that extends circumferentially (e.g., helically, spirally, etc.) over a portion of the outer surface of the mandrel 204 and is angularly offset relative to the longitudinal axis. Thus, the one or more grooves may be referred to as longitudinal or axially offset grooves. Each groove has a depth that extends substantially radially inward from the outer surface of the mandrel 204 and a width configured to receive the lug within the groove. The lug may then be free to travel within the groove and follow the groove in the longitudinally offset path. The application of a rotational force to the mandrel 204 may cause the lug on the collet prop 206 to follow the longitudinally offset path. When the collet prop 206 is constrained from rotational motion due to the interaction with the collet 208 and downhole component 210, the rotational force may be converted into a longitudinal force driving the collet prop 206 out of engagement with the collet 208. While described with respect to the lug being disposed on the collet prop 206 and the groove being disposed on the mandrel 204, the positioning of the lug and groove could be exchanged to allow for an equivalent force conversion between the torsional lock sleeve 202 and the mandrel 204.

In still another embodiment, the force conversion mechanism 218 may comprise a helical spline disposed in an outer surface of the mandrel 204 and one or more corresponding splines disposed on an inner surface of the collet prop 206. In this embodiment, a first plurality of longitudinally offset splines may be formed over a portion of an outer surface of the mandrel 204. Each spline may have a length that extends circumferentially (e.g., helically, spirally, etc.) over a portion of the outer surface of the mandrel 204 and is angularly offset relative to the longitudinal axis of the mandrel 204. Each spline also has a height that extends substantially radially outward from the outer surface of the mandrel 204. A recess may be formed between each pair of adjacent splines. Longitudinally offset splines may be configured to matingly engage and interlock with a set of longitudinally offset splines formed on an inner surface of the collet prop 206. A second plurality of longitudinally offset splines may be formed over a portion of an inner surface of the collet prop 206. Each spline may have a length that extends circumferentially (e.g., helically, spirally, etc.) over a portion of the outer surface of the collet prop 206 and is angularly offset relative to the longitudinal axis of the mandrel 204. Each longitudinally offset spline on the collet prop 206 also has a height that extends substantially radially inward from the inner surface of the collet prop 206. A recess may be formed between each pair of adjacent longitudinally offset splines. In this embodiment, the force conversion mechanism 218 may comprise an engagement and interlocking of the longitudinally offset splines on the mandrel 204 with the corresponding longitudinally offset splines on the collet prop 206. The splines on the collet prop 206 may be free to travel within the recesses between the splines on the mandrel 204 and follow the recess in the longitudinally offset path. The application of a rotational force to the mandrel 204 and/or the collet prop 206 may cause the splines on the collet prop 206 to follow the longitudinally offset path. When the collet prop 206 is constrained from rotational motion due to the interaction with the collet 208 and downhole component 210, the rotational force may be converted into a longitudinal force driving the collet prop 206 out of engagement with the collet 208.

The force conversion mechanism 218 may result in the collet prop 206 longitudinally translating with respect to the mandrel 204. In an embodiment, the translation may be sufficient to disengage the collet prop 206 from the collet 208. In an embodiment, the longitudinal translation may be initially limited due to the interaction of a shoulder 235 on the collet prop 206 with a shoulder 237 on the collet assembly 228. In this embodiment, the collet prop 206 may longitudinally translate until the shoulder 235 on the collet prop 206 engages the shoulder 237 on the collet assembly 228. In this configuration, the collet prop 206 may be disengaged from the collet 208, thereby allowing the collet to release from the downhole component 210.

Once released, the collet 208 may not be torsionally locked with respect to the downhole component 210, and the collet prop 206 may continue to rotate relative to the mandrel 204. In an embodiment, the torsional lock sleeve 202 may be configured to reform the torsional lock with the collet prop 206 if the collet prop 206 translates a sufficient longitudinal distance relative to the mandrel 204. As noted above, the torsional lock sleeve 202 may translate from the first position until the protrusion 233 engages the flange 229, thereby translating the splines or other torsionally locking features on the torsional lock sleeve 202 out of engagement with the corresponding features on the collet prop 206. In this configuration, the splines or other torsionally locking features on the torsional lock sleeve 202 may remain disposed about the collet prop 206, though longitudinally offset from the corresponding locking features on the collet prop 206. The longitudinal translation of the collet prop 206 in response to the rotational force may translate the corresponding locking features on the collet prop 206 towards the splines or other torsionally locking features on the torsional lock sleeve 202. If the collet prop 206 translates a sufficient distance with respect to the mandrel 204, the corresponding locking features on the collet prop 206 can engage the splines or other torsionally locking features on the torsional lock sleeve 202, which may result in the collet prop 206 re-forming the torsional lock with respect to the torsional lock sleeve 202. This engagement may prevent any further rotation of the collet prop 206 with respect to the mandrel 204, thereby preventing any further longitudinal translation of the collet prop 206 with respect to the mandrel 204.

In an embodiment, the release mechanism 200 may be assembled by engaging the collet with the downhole component so that the collet lugs 236 are engaged with the recess in the downhole component 210. The collet prop 206 may then be engaged with the collet 208, and the collet prop 206 may then be engaged with the mandrel 204. For example, the collet prop 206 may be rotated onto the mandrel 204 to engage the force conversion mechanism 218. The torsional lock sleeve 202 may then be disposed over the mandrel 204 with the locking features aligned with the corresponding features on the mandrel 204, and the locking features on the torsional lock sleeve 202 aligned with the corresponding features on the collet prop 206. One or more retaining mechanisms 220 may then be engaged with the torsional lock sleeve 202 and the collet prop 206. The torsional lock sleeve 202 may then be torsionally locked with respect to the mandrel 204, and the engagement between the torsional lock sleeve 202 and the collet prop 206 may further torsionally lock the collet prop 206 with respect to the torsional lock sleeve 202. Since the torsional lock sleeve 202 is torsionally locked with respect to the mandrel 204 and the collet prop 206, the collet prop 206 may be torsionally locked with respect to the mandrel 204. The resulting configuration of the release mechanism 200 may be as shown in FIG. 2. Once the running tool comprising the release mechanism is made up, the running tool and the downhole component may be conveyed within a wellbore and disposed at a desired location.

Figure 5:
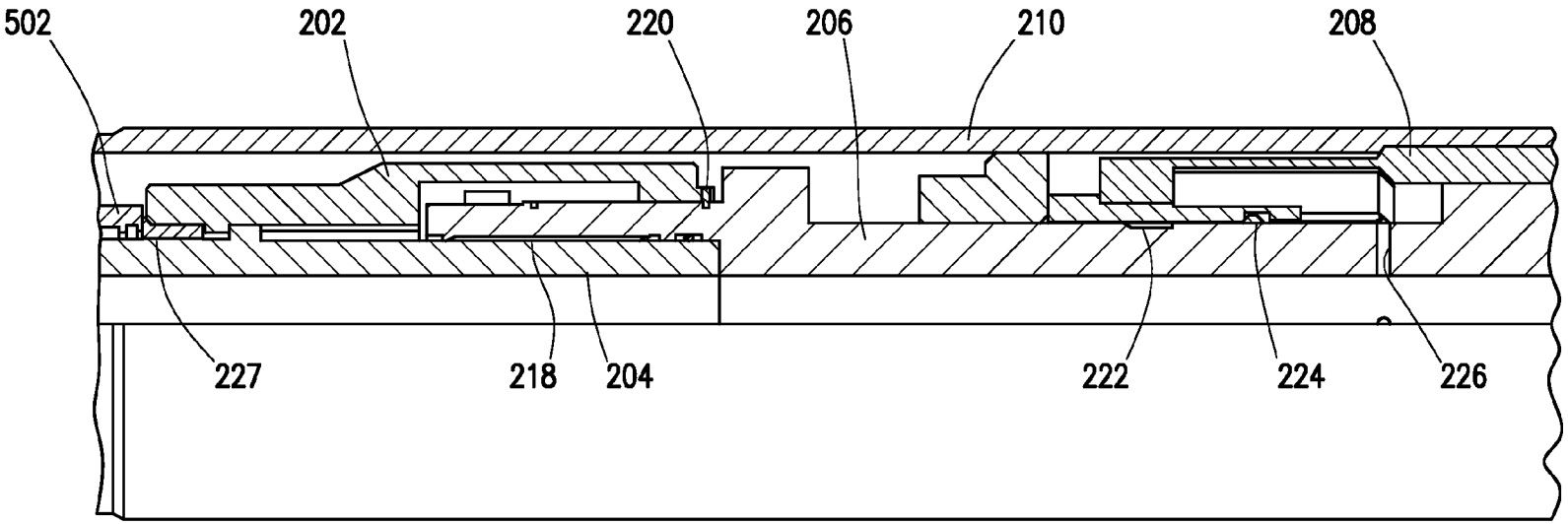
FIG. 5 is still another cut-away view of an embodiment of a release mechanism.

Referring to FIGS. 2 and 5, the downhole component 210 may then be installed and/or used during a servicing operation. At some point in the operation, the downhole component 210 may need to be disengaged from the running tool. During the servicing operation, a shifting assembly 502 may be actuated. For example, an expansion tool disposed between the mandrel 204 and the downhole component 210 may be actuated to expand the downhole component against the casing and/or wellbore wall. The expansion tool may then engage the torsional lock sleeve 202 and apply a force to the torsional lock sleeve 202. Upon the engagement with the torsional lock sleeve 202, the shifting assembly 502 may apply a longitudinal force to the retaining mechanism 220. When the force applied to the retaining mechanism 220 exceeds a threshold, the retaining mechanism 220 may fail, thereby allowing the torsional lock sleeve 202 to longitudinally translate out of the torsionally locked engagement with the collet prop 206. In an embodiment, the shifting assembly 502 comprising the expansion tool may engage the recess 227 and allow any pressure driving the expansion tool to vent through the annular region and through the one or more ports 226, thereby reducing or eliminating the mechanical force applied to the torsional lock sleeve 202. The release mechanism may then be configured as shown in FIG. 5.

Figure 6:
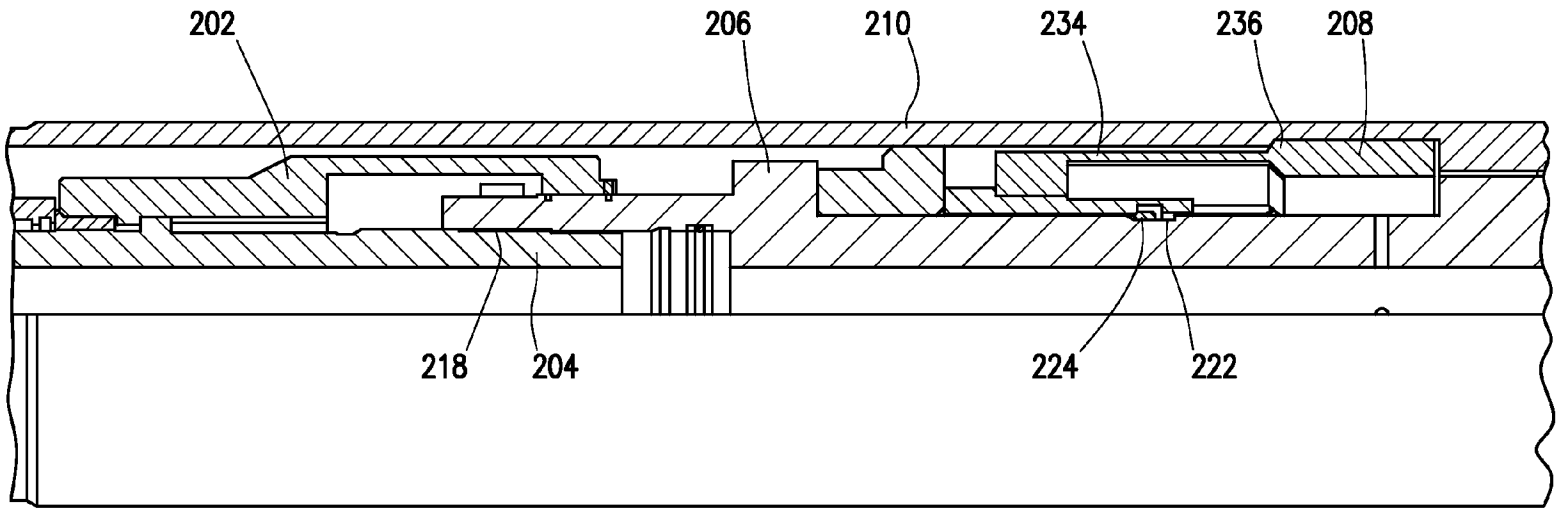
FIG. 6 is yet another cut-away view of an embodiment of a release mechanism.

As shown in FIGS. 5 and 6, the torsional lock sleeve 202 may translate out of the torsionally locked engagement with the collet prop 206, thereby disengaging the torsional lock between the collet prop 206 and the torsional lock sleeve 202. In an embodiment, the torsional lock sleeve 202 may remain disposed about the collet prop 206. In a normal operating environment, the collet prop 206 may be longitudinally translated out of engagement with the collet 208 through the downward translation of the mandrel 204, which is engaged with the collet prop 206. However, in some instances, the mandrel 204 may not be able to be translated in a downward direction. In this case or in the event the release mechanism is desired to be used rather than setting down weight on the running tool to move the mandrel 204 downward, a rotational force may be applied to the collet prop 206 and/or the mandrel 204. The force conversion mechanism 218 may then convert the rotation force into a longitudinal force. For example, the mandrel 204 may be rotated to the right, thereby unscrewing the collet prop 206 and driving the collet prop 206 downward. When a sufficient amount of rotational force, and therefore rotation, has been imparted, the collet prop 206 may be disengaged from the collet 208. In this configuration, the retaining ring 224 may also engage the ring slot 222, thereby providing a fixed engagement between the collet prop 206, the collet 208, and the mandrel 204. The release mechanism may then be configured as shown in FIG. 6.

As shown in FIG. 6, the collet prop 206 may be disengaged from the collet 208 based on the longitudinal translation of the collet prop 206. The collet springs 234 and/or the collet lug 236 may then be able to radially compress in response to a radially compressive force. The radially compressive force may be imparted by providing an upwards force on the mandrel 204, which may be coupled to the collet 208. The retaining ring 224 disposed in the ring slot 222 may prevent the collet prop 206 from longitudinally translating upwards to re-engage the collet 208. Due to the engagement between the collet lug 236 and the edge of the recess in the downhole component 210, the collet springs 234 and collet lug 236 may radially compress and disengage from the recess in the downhole component 210. The running tool comprising the release mechanism may then be disengaged from the downhole component 210 and conveyed upward while the downhole component remains in the wellbore.

While described in terms of disengaging a running tool from the downhole component using the release mechanism, the release mechanism may alternatively be used with other tools such as retrieval tools, work strings, completion strings, and other downhole tools where a release mechanism may be useful.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A release system comprising:

a torsional lock sleeve disposed about a mandrel, wherein the torsional lock sleeve and the mandrel are configured to substantially prevent rotational movement of the torsional lock sleeve about the mandrel, and wherein the torsional lock sleeve is configured to shift between a first position and a second position with respect to the mandrel;

a collet prop engaged with the mandrel, wherein the collet prop is retained in engagement with a collet when the torsional lock sleeve is in the first position, wherein the collet prop is retained in a torsionally locked engagement with the torsional lock sleeve when the torsional lock sleeve is in the first position, and wherein the collet prop is configured to longitudinally translate in response to a rotational movement when the torsional lock sleeve is disposed in the second position; and a shifting assembly configured to engage the torsional lock sleeve and shift the torsional lock sleeve from the first position to the second position.

2. The release mechanism of claim 1, wherein the collet is configured to fixedly engage a downhole component when the collet prop is engaged with the collet.

3. The release mechanism of claim 1, wherein the collet is configured to be disengageable from a downhole component when the collet prop is longitudinally translated out of engagement with the collet.

4. The release mechanism of claim 1, wherein the collet prop is configured to shift between a first collet prop position and a second collet prop position with respect to the mandrel, wherein the collet prop is configured to be retained in engagement with the collet in the first collet prop position, and wherein the collet prop is configured to be out of engagement with the collet in the second collet prop position.

5. The release mechanism of claim 4, wherein the collet prop is configured to re-engage the torsional lock sleeve when the torsional lock sleeve is in the second position and the collet prop is in the second collet prop position.

6. The release mechanism of claim 1, further comprising a retaining mechanism engaged with the torsional lock sleeve and the collet prop, and wherein the retaining mechanism is configured to prevent a longitudinal movement of the torsional lock sleeve relative to the collet prop until a force above a threshold is applied to the retaining mechanism.

7. The release mechanism of claim 6, wherein the retaining mechanism comprises a shear pin, a shear ring, a shear screw, or any combination thereof.

8. The release mechanism of claim 1, wherein the configuration of the torsional lock sleeve and mandrel to substantially prevent rotational movement of the torsional lock sleeve about the mandrel comprises one or more splines disposed on an outer surface of the mandrel, and one or more features disposed on the torsional lock sleeve that are configured to engage the one or more splines.

9. The release mechanism of claim 1, wherein the configuration of the collet prop to longitudinally translate in response to the rotational movement comprises the use of a force conversion mechanism configured to convert the rotational movement into a longitudinal movement.

10. The release mechanism of claim 9, wherein the force conversion mechanism comprises at least one of a threaded engagement between the collet prop and the mandrel, a helical groove disposed in an outer surface of the mandrel and one or more corresponding lugs disposed on an inner surface of the collet prop, a helical groove disposed in an inner surface of the collet prop and one or more corresponding lugs disposed on an outer surface of the mandrel, or a helical spline disposed in an outer surface of the mandrel and one or more corresponding splines disposed on an inner surface of the collet prop.

11. A release system comprising:

a torsional lock sleeve disposed about a mandrel, wherein the torsional lock sleeve is torsionally locked with respect to the mandrel;

a collet prop engaged with the mandrel and the torsional lock sleeve, wherein the engagement between the collet prop and the torsional lock sleeve is configured to torsionally lock the collet prop with respect to the torsional lock sleeve;

a collet engaged with the collet prop, wherein the collet couples the collet prop to a downhole component; and a shifting assembly configured to engage the torsional lock sleeve and shift the torsional lock sleeve from a first position to a second position.

12. The release mechanism of claim 11, wherein the mandrel comprises one or more splines configured to engage one or more corresponding splines on the torsional lock sleeve, and wherein the engagement of the one or more splines on the mandrel with the one or more splines on the torsional lock sleeve provides the torsional lock of the torsional lock sleeve with respect to the mandrel.

13. The release mechanism of claim 11, wherein the shifting assembly comprises an expansion cone assembly.

14. The release mechanism of claim 11, wherein the collet prop comprises one or more splines disposed over a portion of a surface of the collet prop, and wherein the torsional lock sleeve is configured to engage the one or more splines in the first position and be out of engagement with the splines in the second position.

15. The release mechanism of claim 11, wherein the collet prop is threadedly engaged with the mandrel.

16. The release mechanism of claim 11, wherein the threaded engagement between the collet prop and the mandrel comprises left handed threads.

17. The release mechanism of claim 11, wherein the downhole component comprises a liner hanger, a liner, a liner patch, a screen, or any combination thereof.

18. A method comprising:

engaging a shifting assembly with a torsional lock sleeve when the torsional lock sleeve is in a first position, wherein the torsional lock sleeve is torsionally locked with respect to a collet prop in the first position, and wherein the torsional lock sleeve is torsionally locked with respect to a mandrel;

longitudinally translating the torsional lock sleeve to a second position in response to the engagement of the shifting assembly with the torsional lock sleeve;

rotating the collet prop or the mandrel when the torsional lock sleeve is in the second position;

longitudinally translating the collet prop based on the rotating; and disengaging the collet prop from a collet based on the longitudinal translation of the collet prop.

19. The method of claim 18, further comprising torsionally locking the collet prop with respect to the torsional lock sleeve when the torsional lock sleeve is in the second position and when the collet prop is disengaged from the collet.

20. The method of claim 18, further comprising disengaging the collet from a downhole component when the collet prop is disengaged from the collet.

* * * * *